United States Patent [19]

Matthews

[11] 4,030,624

[45] June 21, 1977

[54] LOADER VEHICLES

[75] Inventor: Harry Matthews, Worsley, England

[73] Assignee: Massey-Ferguson Services N.V., Curacao, Netherlands

[22] Filed: Dec. 31, 1975

[21] Appl. No.: 645,833

[30] Foreign Application Priority Data

Jan. 4, 1975 United Kingdom ..... 00352/70

[52] U.S. Cl. ..... 214/145 A; 172/272

[51] Int. Cl.² ..... E02F 3/81

[58] Field of Search ..... 214/145 A; 24/243 FM; 172/272

[56] References Cited

UNITED STATES PATENTS

| | | | |
|---|---|---|---|
| 3,606,052 | 9/1971 | Schurz | 214/145 A |
| 3,705,656 | 12/1972 | Hunger et al. | 214/145 A |
| 3,876,091 | 4/1975 | MacDonald | 214/145 A |

FOREIGN PATENTS OR APPLICATIONS

| | | | |
|---|---|---|---|
| 814,808 | 6/1969 | Canada | 214/145 A |
| 213,563 | 6/1967 | Sweden | 214/145 A |

*Primary Examiner*—L. J. Paperner
*Assistant Examiner*—Ross Weaver
*Attorney, Agent, or Firm*—Thomas P. Lewandowski

[57] ABSTRACT

A bracket is provided to be mounted on the forward end of the loader arms and to connect the loader arms to the bucket or the like in a readily detachable manner. The bracket is provided with securing means which operate sequentially to first lock the bracket to the loader arms and secondly lock the bucket to the bracket. The geometric relationship between the bucket and the loader arms is thus unaffected.

9 Claims, 6 Drawing Figures

LOADER VEHICLES

This invention relates to methods of and means for attaching load carrying implements to load fitting implements.

It is known to provide a load carrying implement, for example a bucket for a scoop arm machine, with a hook adapted to engage a bracket carried by the arms of the machine. In order to fasten the bucket securely to the bracket, pins are provided which may be inserted individually into aligned holes in the bucket and bracket or may be inserted remotely, for example by a hydraulic ram. Such arrangements are known as Quick Hitch attachments since the load carrying implement may readily be removed from the machine.

However, the machine must also be able to use standard buckets which are attached to the arms of the machine without the intermediary of the bracket. This means that the bracket must also be readily detachable from the arms and this is usually achieved by means of pins similar to those that connect the bucket to the bracket.

For simplicity of construction it has previously been necessary to space the holes used to connect the bracket to the arm from the holes used to connect the bracket to the bucket. This, however, alters the geometric relationship between the bucket and the arm and may result in unsatisfactory operation of the machine.

A further disadvantage of such an arrangement is that the bracket must transmit all loads from the bucket to the arms and must therefore be relatively robust and heavy.

It is an object of the present invention to obviate or mitigate the above disadvantages.

According to the present invention there is provided a load carrying implement, a bracket adapted to be connected to said load carrying implement in a readily detachable manner, load lifting means adapted to be connected to said bracket, securing means for locking said lifting means to said bracket and for locking said bracket to said load carrying implement and so arranged that initial actuation of said securing means locks said bracket to said lifting means and further actuation of said securing means locks said bracket to said load carrying implement.

According also to the present invention there is provided a bracket for connecting a load carrying implement to load lifting means in a readily detachable manner, said bracket being provided with securing means movable relative to said bracket to lock said bracket to said load lifting means and further movable to lock said load carrying implement to said bracket.

Preferably said securing means are a plurality of axially movable pins each adapted to co-operate with holes in said load lifting means and in said load carrying implement.

Preferably also means are provided to prevent accidental movement of said securing means.

As a further preference a mechanism is provided to move said pins conjointly.

An embodiment of the invention will now be described by way of example only with reference to the accompanying drawings in which FIG. 1 is a side view of a scoop arm machine having a quick hitch attachment.

Figure 1:
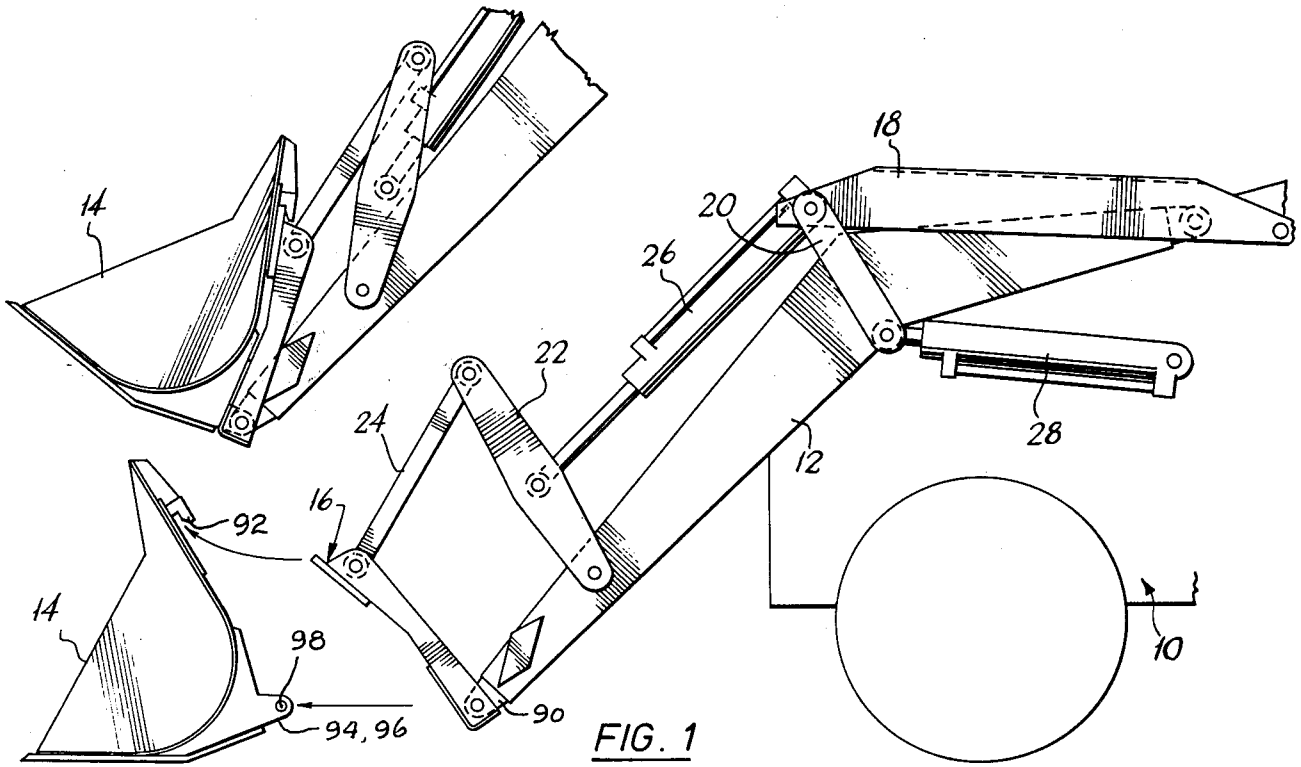

Referring now to FIG. 1 a shovel loader comprises a dirigible vehicle 10 having a load lifting structure 12, commonly referred to as the loader arms, pivotally connected at one end thereto. A load carrying implement, namely a bucket 14, is pivotally connected to the loader arms 12 through the intermediary of a bracket 16. A levelling linkage comprising links 18, 20, 22 and 24 and a bucket tilt ram 26 is provided to maintain the bucket 14 at the optimum disposition relative to the ground as the loader arms 12 are raised by means of a hydraulic ram 28.

Figure 2:
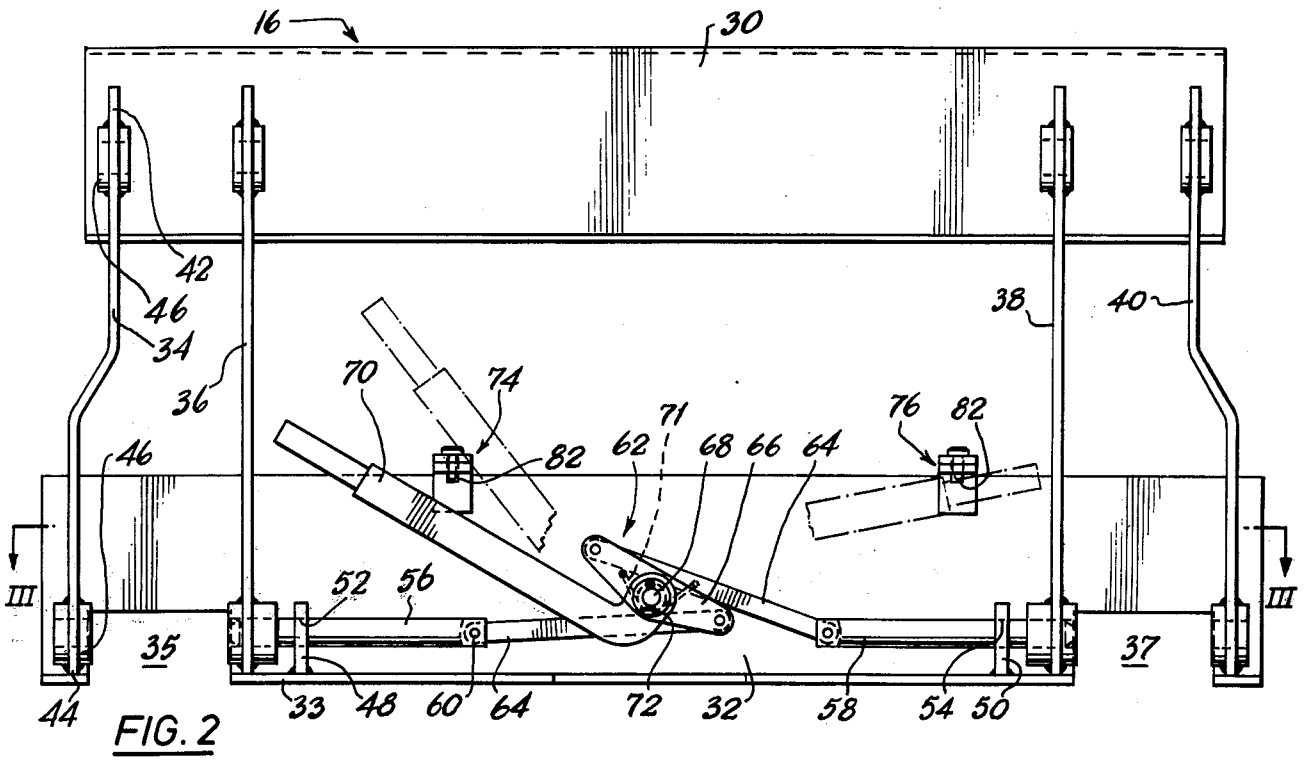
FIG. 2 is a rear view of a bracket used to connect the bucket to the loader arms of the machine shown in FIG. 1.
Figure 3:
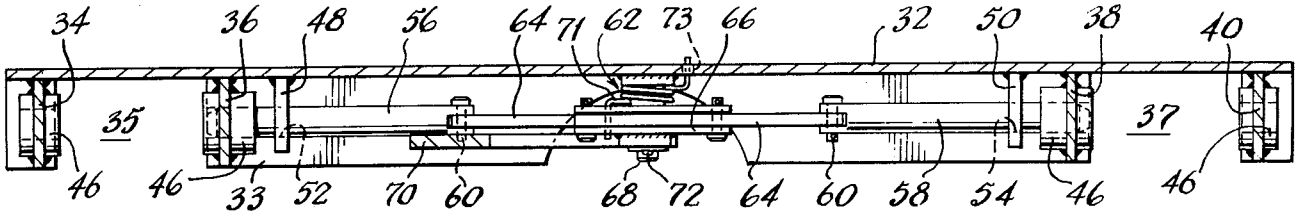
FIG. 3 is a view on the line III — III of FIG. 2.

As can best be seen from FIG. 2 the bracket 16 comprises two horizontally extending plates 30, 32 interconnecting four vertical support members 34, 36, 38, 40. The outer two members 34, 40 are cranked so that the spacing between the adjacent members is greater at the bottom than at the top.

The plate 32 is formed with a horizontally lip 33 and apertures 35, 37 are formed in the plate 32 and the lip 33 between the members 34, 36 and 38, 40 respectively.

Each of the support members 34, 36, 38, 40 has a pair of holes 42, 44 formed in them and an annular bush 46 is welded into each hole so that adjacent buses are coaxial. Guides 48, 50 are welded to the plate 32 and are provided with holes 52, 54 respectively which are coaxial with the bushes 46.

Pins 56, 58 slide axially in the guides 48, 50 and the bushes 46 and are connected by a pivot 60 to a toggle mechanism 62. The toggle mechanism 62 comprises a pair of thrust links 64 which are pivotally connected to an arm 66 rotatably mounted on a support pin 68 and retained by a split pin 72. A handle 70 is welded to the arm 66 for movement therewith.

Figure 6:
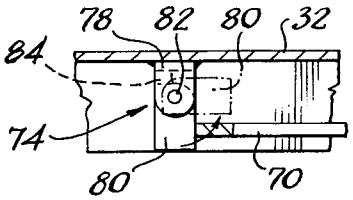
FIG. 6 is a detail view of a stop provided on said bracket.

Two stops 74, 76 are welded to the rear face of the plate 32 to hold the handle 70 in two positions, the handle 70 being biased toward the position indicated in solid lines by a torsion spring 71 acting between the arm 66 and a hole 73 in the plate 32. As can best be seen in FIG. 6, each stop comprises an angled bracket 78 and a striker plate 80 which are pivotally connected by a pin 82. An abutment 84 is provided below the bracket 78 adjacent the pin 82 and the end of the striker plate 80 is radiussed so that it may move anticlockwise about the pin 82 but not clockwise.

Figure 5:
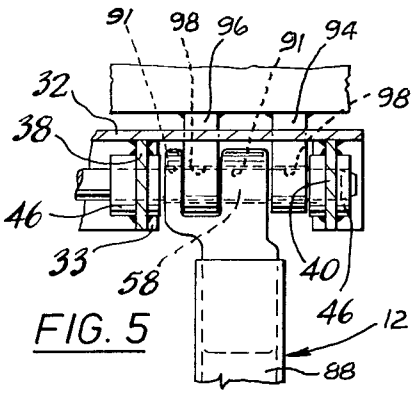
FIG. 5 is an enlarged detail view showing the position of the locking pin with the bracket attached to the loader arm and the bucket.
Figure 4:
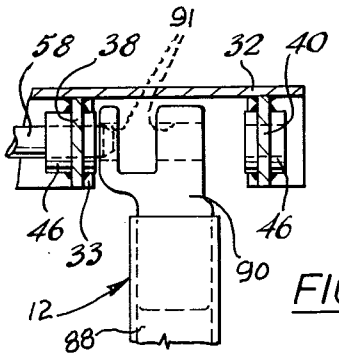
FIG. 4 is an enlarged detail view showing the position of the locking pin with the bracket attached to the loader arm.

Referring to FIGS. 4 and 5, the loader arms 12 are formed from a tubular member 88 which is connected to a forked forging 90 which has a through bore 91.

The bucket 14 is provided with a lip 92 in the form of a hook and a pair of spaced lugs 94, 96 which have a hole 98 formed in them.

The device operates as follows.

The vehicle is positioned so that the forked forgings 90 are within the apertures 35, 37 on the bracket 16 and the bores 91 are aligned with the holes 42. The lever 70 is then rotated clockwise as viewd in FIG. 2, causing the pins 56, 58 to move axially in the bushings 46. The lever 70 is moved until it passes the stop 74, the striker plate 80 pivoting on the pin 82 to allow the lever 70 to pass. The plate 80 is replaced so that it abuts the abutment 84 and the torsion spring 71 holds the lever 70 against the plate 80. With the lever 70 abutting the stop 74 the pins 56, 58 have moved to lock the bracket 16 to the loader arms 12 as shown in FIG. 4.

The link 24 is secured to the bracket 16 by pins 100 which are secured by lynch pins 101.

To connect the bucket 14 to the bracket 16, the tilt ram 26 is extended so that the plate 30 is in advance of the plate 32. The bracket 16 is positioned adjacent the lip 92 and the lift arms 12 raised by the ram 28. The plate 30 engages with the lip 92 and the lugs 94, 96 enter the apertures 35, 37 between the forks of the forked forging 90 so that the bore 91 is aligned with holes 46.

The lever 70 is rotated further clockwise and the pins 56, 58 slide through the bore 91 and secure the bucket 14 to the bracket 16. The stop 76 prevents the bucket being unintentionally unlocked. To release the bucket 14, the lever 70 is moved anticlockwise past the stop 76 to abut the stop 74 and the lift arms 12 lowered until the bucket 14 rests on the ground. Further lowering of the lift arms 12 will cause the plate 30 to disengage from the lip 90 and the vehicle may be reversed away from the bucket 14.

To disengage the bracket 16 from the loader vehicle, the lever 70 is moved past the stop 74 and the pins 100 removed.

The bucket 14 may be attached directly to the lift arms 12 by use of conventional pins similar to the pins 100.

It will be seen that a device is provided that allows load carrying implements to be readily interchanged yet does not alter the geometrical relationship between the vehicle and the implement. Further the bucket may be readily detached for the use of a conventional load carrying implement. Since the loads are transmitted from the bucket 14 to the arms 12 through the pins 56, 58, the bracket 16 may be made relatively light so that the lifting capacity of the loader is not significantly affected and the bracket may be easily removed and manipulated.

What we claim is:

1. An implement coupling mechanism detachably secured to load lifting means for ready attachment and detachment of a load carrying implement comprising a bracket for supporting the implement, a selectively engageable portion thereof, first and second members on the loading lifting means, securing means for engaging said engageable portion of said bracket to lock said bracket to said first member in a first portion of said securing means, a lug on the implement for engagement by said securing means for selectively locking the implement to said bracket and said second member in a second position of said securing means, said first member located inbetween said engageable portion of said bracket and said lug, said securing means located on said bracket means to permit said securing means to unlock said implement by disengaging said lug and said second member without unlocking said bracket when said securing means moves from the second to the first position, said bracket remaining engaged by said engageable portion of said bracket and said first member being engaged by said securing means, said bracket being disengageable from said lifting means by movement of said securing means to a third position.

2. Apparatus according to claim 1 wherein said load lifting means includes a pair of arms, each of said arms having first and second members in the form of a forked member at one end thereof, one leg of said forked member being engaged by said securing means to lock said bracket to said lifting means.

3. Apparatus according to claim 2 wherein said load carrying implement is provided with a pair of lugs adapted to pass either side of the other leg of said forked member and be locked thereto by said securing means.

4. Apparatus according to claim 3 wherein said securing means are pins and through bores are provided in each leg of said forked member, and in each of said lugs.

5. Apparatus according to claim 4 wherein said bracket comprises a pair of horizontally extending plates interconnected by four vertical plates arranged in pairs at opposite ends of said horizontal plates, each of said pair of plates straddling an aperture in one of said horizontal plates, each of said plate having axially aligned annular bushes therein adjacent said apertures and adapted to receive said pins and guide them for sliding movement relative said bracket.

6. Apparatus according to claim 5 wherein a pair of pins are provided each of which is associated with one of said pairs of vertical plates, said pins being operated conjointly by a mechanism.

7. Apparatus according to claim 6 wherein said mechanism comprises a manual lever pivotally mounted on said one horizontal plate and a pair of links pivotally connected to said handle on opposite sides of said pivot point and each connected to one of said pins.

8. Apparatus according to claim 7 including first stop means to prevent accidental movement of said manual lever when said pins engage said other leg and said pair of lugs.

9. Apparatus according to claim 8 including second stop means to prevent accidental movement of said manual lever when said pins engage said leg and said engageable portion of said bracket.

* * * * *